US011137147B2

(12) United States Patent
King

(10) Patent No.: US 11,137,147 B2
(45) Date of Patent: Oct. 5, 2021

(54) VARIABLY HEATABLE RADIATOR

(71) Applicant: Ray King, Pickering (CA)

(72) Inventor: Ray King, Pickering (CA)

( * ) Notice: Subject to any disclaimer, the term of this patent is extended or adjusted under 35 U.S.C. 154(b) by 319 days.

(21) Appl. No.: 15/935,075

(22) Filed: Mar. 26, 2018

(65) Prior Publication Data

US 2019/0293304 A1 Sep. 26, 2019

(51) Int. Cl.

| | |
|---|---|
| ***F24D 19/10*** | (2006.01) |
| ***F24D 15/02*** | (2006.01) |
| ***F24D 13/04*** | (2006.01) |
| ***F24H 9/20*** | (2006.01) |
| ***F24H 6/00*** | (2006.01) |
| *F24H 3/06* | (2006.01) |
| *F24H 3/12* | (2006.01) |
| *F24H 7/04* | (2006.01) |
| *F24H 7/06* | (2006.01) |

(52) U.S. Cl.

CPC ..... *F24D 19/1096* (2013.01); *F24D 15/02* (2013.01); *F24H 6/00* (2013.01); *F24H 9/2028* (2013.01); *F24H 9/2071* (2013.01); *F24D 2200/08* (2013.01); *F24H 2250/02* (2013.01)

(58) Field of Classification Search

CPC .. F24D 19/1096; F24D 19/1084; F24D 15/02; F24D 13/04; F24D 2200/08; F24H 6/00; F24H 9/2028; F24H 9/2071; F24H 9/2021; F24H 1/06; F24H 1/185; F24H 1/201; F24H 1/38; F24H 3/004; F24H 7/002; F24H 7/0233; F24H 7/0433; F24H 7/062; F24H 2250/02

USPC ..... 237/7, 70

IPC ..... F24D 13/04

See application file for complete search history.

(56) References Cited

U.S. PATENT DOCUMENTS

| | | | | |
|---|---|---|---|---|
| 1,528,494 A * | 3/1925 | Lennig | F24H 9/2078 | 392/378 |
| 1,528,495 A * | 3/1925 | Lennig | F24H 3/004 | 392/378 |
| 1,619,865 A * | 3/1927 | Head | F24H 3/006 | 392/311 |
| 1,727,564 A * | 9/1929 | Salisbury | F24H 3/004 | 392/398 |
| 1,728,309 A * | 9/1929 | Shreeve | F24H 3/004 | 392/378 |

(Continued)

FOREIGN PATENT DOCUMENTS

| | | | |
|---|---|---|---|
| EP | 80428 A1 * 11/1982 | F24D 13/04 |
| EP | 1249667 A1 * 10/2002 | F24D 13/04 |
| WO | WO-2004102077 A1 * 11/2004 | F24D 13/04 |

*Primary Examiner* — Steven B McAllister
*Assistant Examiner* — Daniel E. Namay
(74) *Attorney, Agent, or Firm* — Shawn Gordon, Esq.; Dunkiel Saunder Elliott Raubvogel & Hand, PLLC

(57) ABSTRACT

A variable heatable radiator for use in a fluid circuit containing coolant therein, and which can generate substantial amounts of heat to heat larger spaces, such as in a home or business, while utilizing minimal power to run, and which can be utilized in various implementations and configurations. The radiator can be selectively activated or de-activated by, for example, a cell phone or the like whereby the fluid circuit in the radiator can be monitored for time of use, temperature and cost of use. The circuit possesses at least one opening defined therein on sides of the radiator and top and bottom thereof which is in communication with the circuit, whereby a heating element can be inserted to heat the fluid.

2 Claims, 5 Drawing Sheets

(56) References Cited

U.S. PATENT DOCUMENTS 1,763,328 A * 6/1930 Robinson ..... F24H 3/004 392/378
1,788,515 A * 1/1931 Gannon ..... F24H 3/004 392/357
1,840,598 A * 1/1932 Murray ..... F24D 15/02 392/307
1,866,221 A * 7/1932 Pennington ..... F24H 3/004 392/357
1,941,855 A * 1/1934 Eggleston ..... F24H 3/004 392/377
1,945,815 A * 2/1934 Landerman ..... F24H 3/004 392/357
2,031,882 A * 2/1936 Freeman ..... F24H 3/004 392/378
2,034,612 A * 3/1936 Fogg ..... F24H 3/004 392/378
2,034,800 A * 3/1936 Dougherty ..... F24H 3/004 392/378
2,477,734 A * 8/1949 Gehrke ..... F24F 6/025 392/358
2,480,809 A * 8/1949 Freyman ..... F24H 3/004 392/378
3,166,666 A * 1/1965 Williams, Jr. ..... F24H 3/004 392/377
3,179,788 A * 4/1965 Uhlig ..... F24H 3/006 392/359
6,289,175 B1 * 9/2001 De' Longhi ..... F24H 3/004 392/357
7,614,114 B1 * 11/2009 Bucher ..... B60B 33/0002 16/29
9,022,299 B2 * 5/2015 Jones ..... F24H 3/004 237/70
2002/0076213 A1 * 6/2002 Pelonis ..... F24H 3/0417 392/358
2004/0057707 A1 * 3/2004 Lamb ..... F24H 3/004 392/394
2007/0065123 A1 * 3/2007 Yao ..... F24H 3/004 392/375
2010/0027980 A1 * 2/2010 Yao ..... F28D 1/0226 392/377
2010/0078425 A1 * 4/2010 Wang ..... F24H 3/004 219/538
2010/0133352 A1 * 6/2010 Jones ..... F24D 19/1096 237/12
2013/0062336 A1 * 3/2013 Zhang ..... F24H 9/1863 219/530
2018/0098382 A1 * 4/2018 Kaylor ..... F24D 15/02

* cited by examiner

Figure 1 - Prior Art

VARIABLY HEATABLE RADIATOR

This invention relates generally to a radiator, and more particularly to an improved variably heatable radiator for use in a circuit having fluid therein, which can be selectively activated or de-activated by, for example, a cell phone or the like whereby the circuit can be monitored for time of use, temperature and cost of use, and which can be heated in a multitude of variable ways to encompass, and avoid restructuring of, existing plumbing and electrical lines in a building. The circuit possesses at least one opening defined therein on sides of the radiator and top and bottom thereof which is in communication with the circuit, whereby a heating element can be inserted to heat the fluid.

DESCRIPTION OF THE PRIOR ART

It is well known that radiators are used to transfer thermal energy from one medium to another for the purpose of cooling and heating. It is also known that radiators are commonly used to heat homes and buildings. In a central heating system using radiators, hot water or sometimes steam is generated in a central boiler, and circulated by pumps through radiators within the home or building, where this heat is then transferred to the surroundings. FIG. 1 provides an example of such a radiator 1, having connections 2, for example, to gas lines, power, propane, pumps, pressure gauges, flow switches, filters, tubing throughout the radiator and home.

However, such systems can lead to excessive cost, and usually continually draw power and energy for their use, especially in winter, and therefore incur higher heating costs. Furthermore, such systems can have larger footprints overall, making them cumbersome to use in smaller spaces. Moreover, radiators can produce very high unsafe temperatures at local areas of a room, particularly in an area adjacent the radiator.

What is required is an improved variably heatable radiator which has a generally uncomplicated and simple design, which has a minimal footprint, and which can generate substantial amounts of heat to heat larger spaces, such as in a home or business, without CO2 or other emissions, while utilizing minimal power to run, and which can be utilized in various implementations and configurations.

Furthermore, there is required an improved variably heatable radiator which can be heated in a multitude of variable ways to encompass, and avoid restructuring of, existing plumbing and electrical lines in a building. Thus, there is a need for an improved environmentally friendly variably heatable radiator for heating a space which may be installed easily, and is durable and reliable, which can be selectively activated or de-activated by, for example, a cell phone or the like whereby the circuit can be monitored for time of use, temperature and cost of use, and which can be heated in a multitude of variable ways to encompass, and avoid restructuring of, existing plumbing and electrical lines in a building and which possesses easily removable or replaceable heating elements within the radiator. Furthermore, there is a need for a radiator which can be a "stand alone" radiator, or connected to existing power, plumbing and electrical lines in a conventional manner. In this regard, the present invention substantially fulfills these needs.

SUMMARY OF THE INVENTION

It is an object and advantage of the present invention to provide an improved radiator which has a generally uncomplicated and simple design, and which has a minimal footprint.

It is another object and advantage of the present invention to provide an improved radiator which can generate substantial amounts of heat to heat larger spaces, such as in a home or business, while utilizing minimal power to run, and which can be utilized in various implementations and configurations.

It is yet another object and advantage of the present invention to provide an improved radiator for use in a circuit having fluid therein, which can be selectively activated or de-activated by, for example, a cell phone or the like and whereby the circuit can be monitored for time of use, temperature and cost of use, and which can be heated in a multitude of variable ways to encompass, and avoid restructuring of, existing plumbing and electrical lines in a building.

According to one aspect of the present invention, there is provided a variably heatable radiator for heating a space, comprising a fluid circuit within the radiator for retaining coolant therein, the fluid circuit further comprising at least one opening defined therein on sides of the radiator and top and bottom thereof which is in communication with the fluid circuit; at least one heating element constructed and arranged for insertion into the at least one opening and projecting into the fluid circuit, the at least one heating element being removable without disassembly of the fluid circuit, whereby the at least one heating element is in direct contact with the coolant to heat the coolant; and monitoring means for selectively activating or de-activating the radiator through a remote device, and monitoring parameters of the radiator.

According to another aspect of the present invention, there is provided a variably heatable radiator for heating a space, comprising a fluid circuit within the radiator for retaining coolant therein, the fluid circuit further comprising at least one opening defined therein on sides of the radiator and top and bottom thereof which is in communication with the fluid circuit; at least one heating element constructed and arranged for insertion into the at least one opening and projecting into the fluid circuit, the at least one heating element being removable without disassembly of the fluid circuit, whereby the at least one heating element is in direct contact with the coolant to heat the coolant; at least one radiator panel for securing therein the fluid circuit; a thermostatic control adapted to selectively turn off the radiator when a selected determined shut off temperature within the fluid circuit has been achieved, and then activate the heat emitting radiator to an active position when a selected turn on temperature within the fluid circuit has been achieved; and a sensor for monitoring parameters of the radiator through a remote device.

According to another aspect of the present invention, there is provided a method of manufacturing a variably heatable radiator comprising the steps of providing a fluid circuit within the radiator for retaining coolant therein, providing the fluid circuit with at least one opening defined therein on sides of the radiator and top and bottom thereof for being in communication with the fluid circuit; providing at least one heating element constructed and arranged for insertion into the at least one opening to project into the fluid circuit; enabling the at least one heating element to be removable without disassembly of the fluid circuit, whereby the at least one heating element is in direct contact with the coolant to heat the coolant; and providing monitoring components for selectively activating or de-activating the radiator through a remote device, and monitoring parameters of the radiator.

BRIEF DESCRIPTION OF THE DRAWINGS

A preferred embodiment of the present invention is described below with reference to the accompanying drawings, in which.

DESCRIPTION OF THE PREFERRED EMBODIMENT

In the preferred embodiment, and with reference to FIGS. 2 to 5, the variable heatable radiator 3 of the present invention comprises various components, as hereinafter described. This radiator, in an exemplary embodiment, has therein monitoring components for selectively activating or de-activating the radiator through a remote device, and monitoring parameters of the radiator. In an exemplary embodiment, the radiator possesses an internal fluid circuit (or, alternatively, could also utilize a closed loop fluid flow circuit). The present invention has a generally uncomplicated and simple design, has a minimal footprint, and can generate substantial amounts of heat to heat spaces, such as in a home, business or otherwise, while utilizing minimal power to run, and can be utilized in various implementations and configurations. Furthermore, the radiator 3 of the present invention can be heated in a multitude of variable ways to encompass, and avoid restructuring of, existing plumbing and electrical lines in a building, as the radiator can be a "stand alone" radiator, or connected to existing power, plumbing and electrical lines in a conventional manner.

Figure 1:
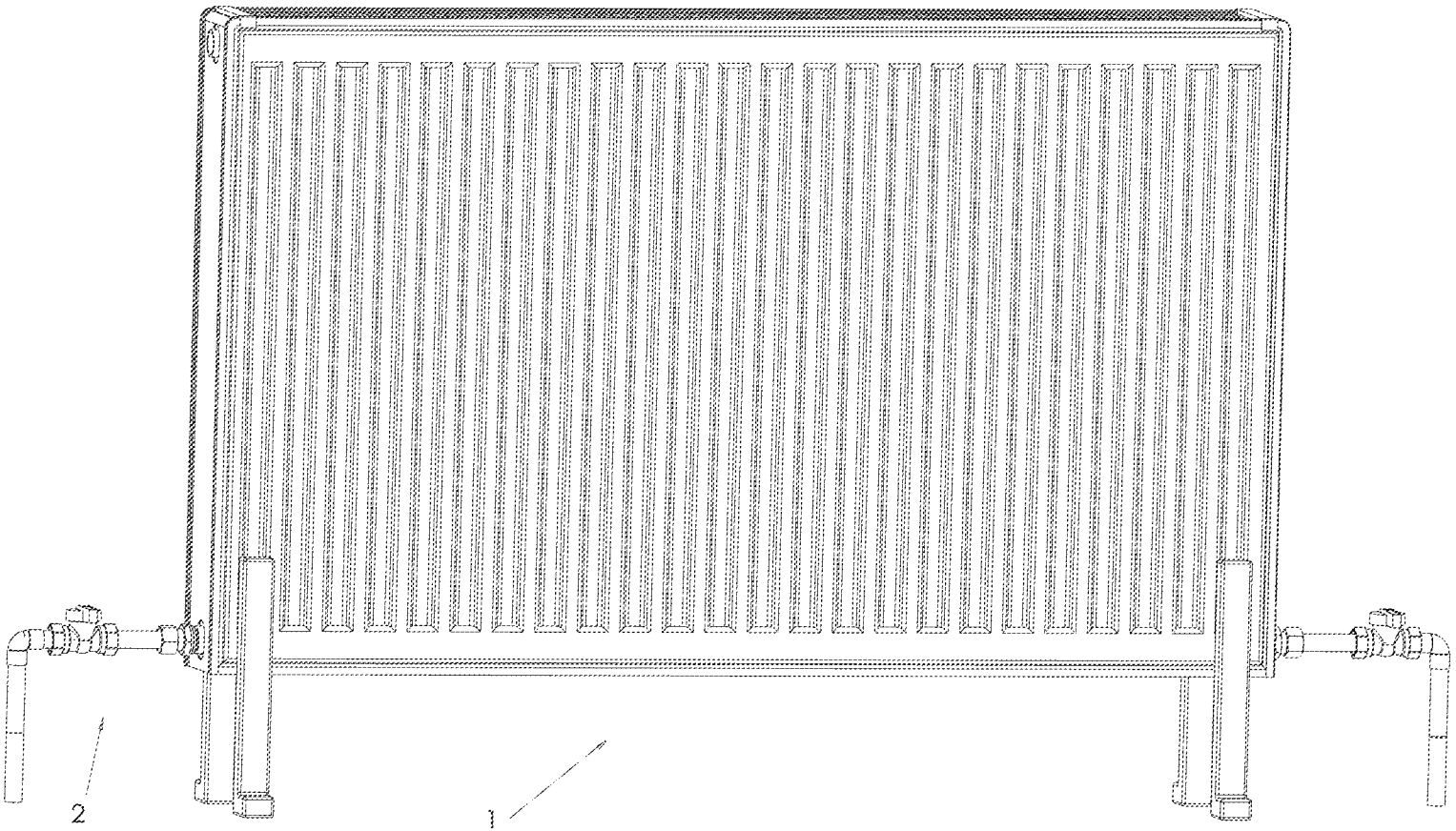
FIG. 1 is a front perspective view of a prior art radiator.
Figure 2:
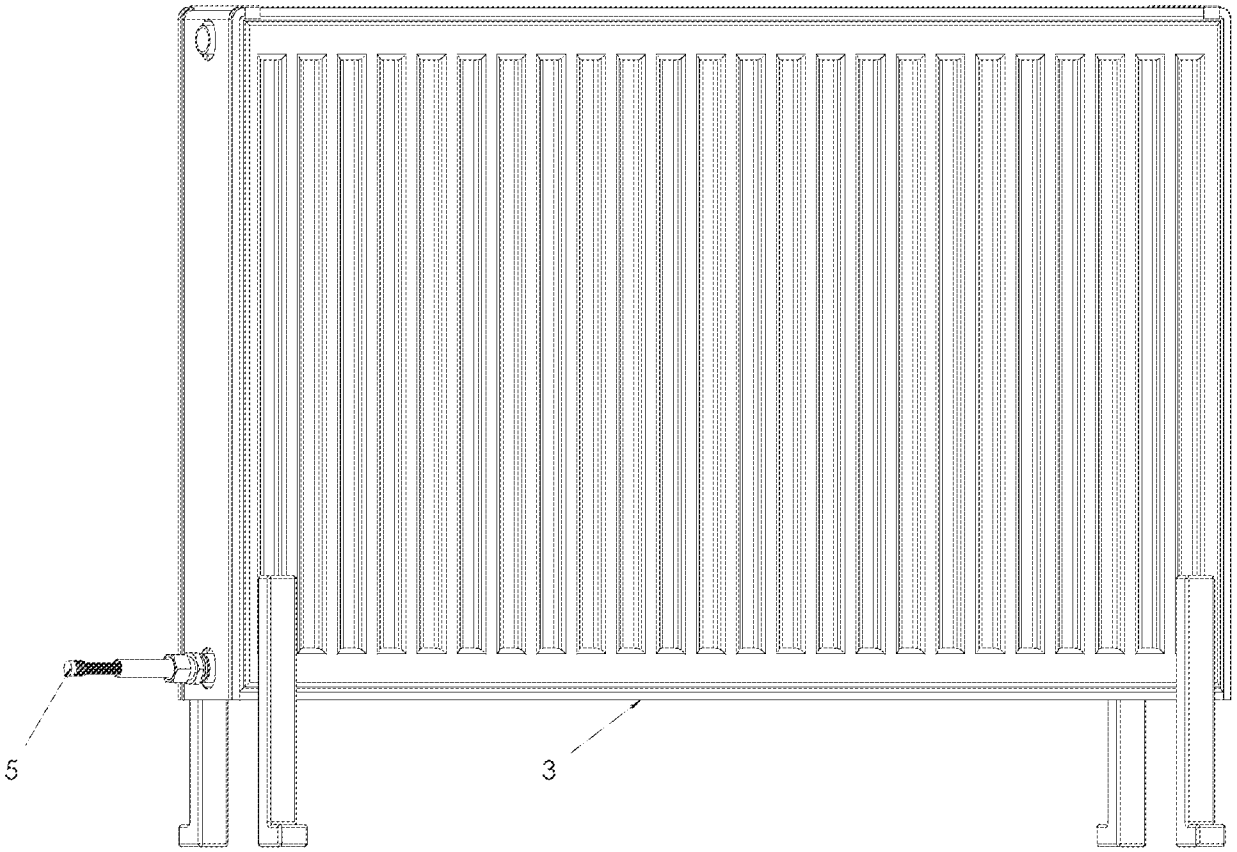
FIG. 2 is a front perspective view of an embodiment of the radiator of the present invention.
Figure 3:
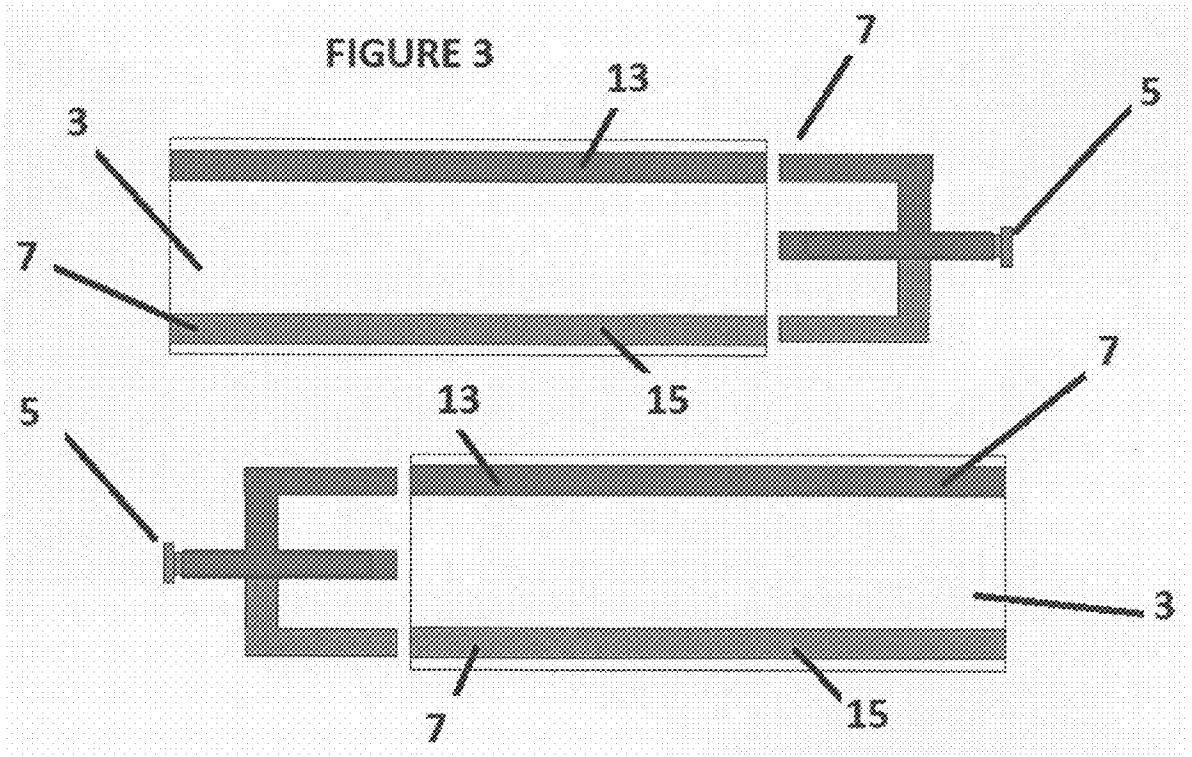
FIG. 3 is a side view of the embodiment of the radiator of the present invention shown in FIG. 2, illustrating the heating element beginning to heat the fluid in the upper half of the fluid circuit.
Figure 4:
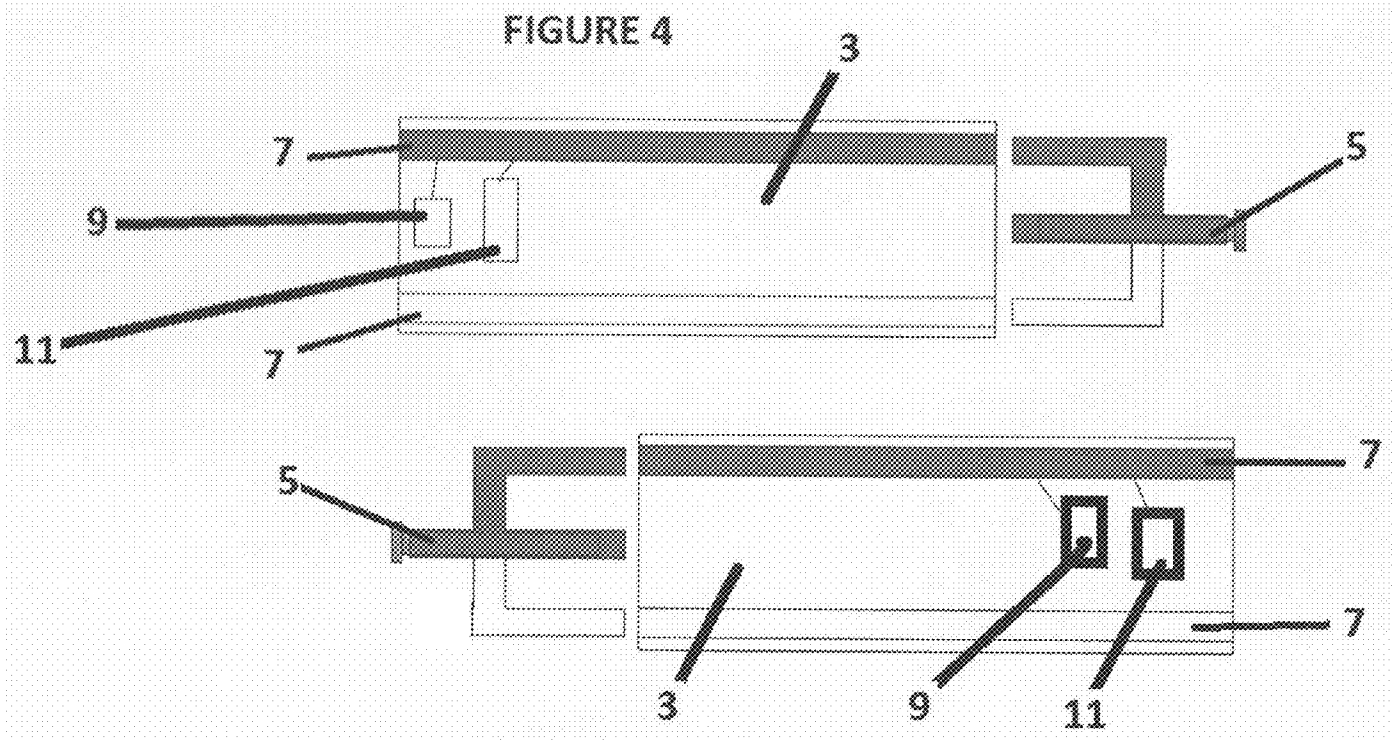
FIG. 4 is a side view of the embodiment of the radiator of the present invention shown in FIG. 3, illustrating the heating element beginning to also heat the fluid in the lower half of the fluid circuit.
Figure 5:
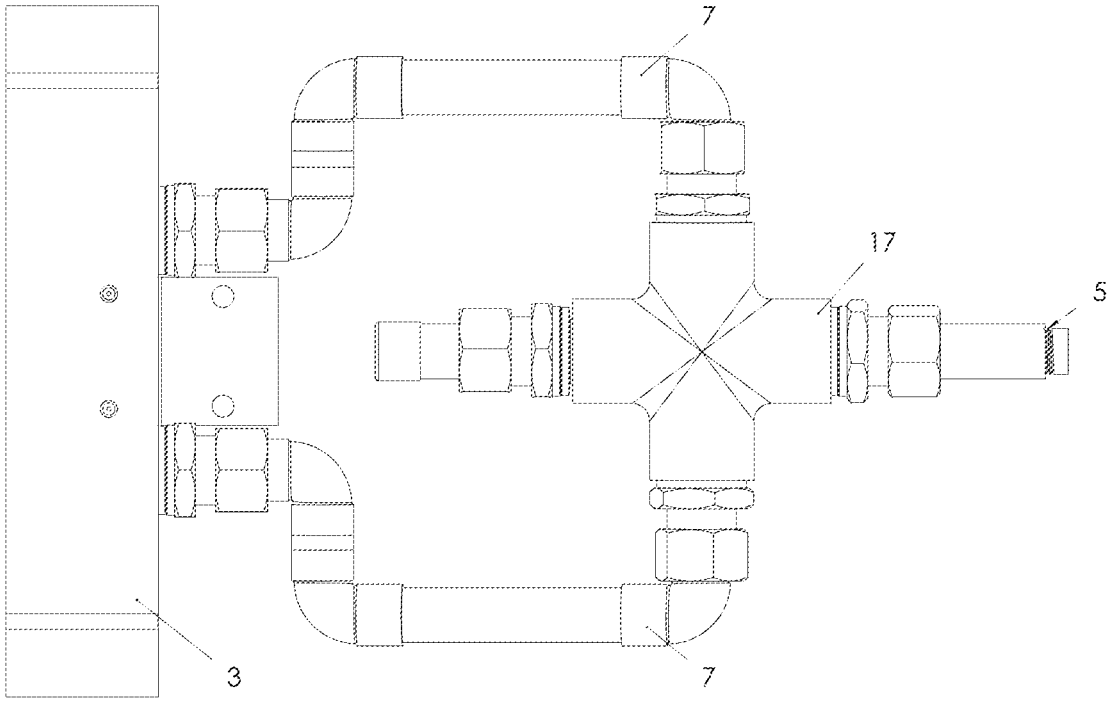
FIG. 5 is a side view of one embodiment of the radiator of the present invention, illustrating a heating element projecting into the fluid circuit on the right side thereof.

With reference to FIGS. 3 to 5, the radiator 3 of the present invention comprises a fluid circuit 7 positioned within the radiator 3, the fluid circuit 7 being, in one exemplary embodiment, a closed hollow tube integrated therewith (and having coolant therein), though it will be understood that one or more such interconnected flow tubes comprising the fluid circuit 7 could be utilized, as would be apparent to one skilled in the art. Of course, the fluid circuit will contain coolant therein which, in an exemplary embodiment, is water.

As can also be readily seen in FIG. 5, a heating element 5 is inserted to project into the fluid circuit 7, it being understood, of course, that such positioning of the heating element 5 can occur anywhere along a length of the fluid circuit 7, to be in direct contact with the coolant within the fluid circuit 7 and heat it. Of course, it will be readily understood that a plurality of such heating elements could also be used, as would be apparent to one skilled in the art. In an exemplary embodiment, the fluid circuit possesses at least one opening 17 defined therein on sides of the radiator, and/or the top and bottom thereof, which is in communication with the fluid circuit, whereby the fluid can be heated. In this manner, the radiator 3 of the present invention can be heated in a multitude of variable ways to encompass, and avoid restructuring of, existing plumbing and electrical lines in a building, as the radiator can be a "stand alone" radiator providing the ultimate flexibility in installation.

In an alternative embodiment, the radiator 3 can be a closed loop fluid flow circuit for permitting a flow of the coolant therethrough, wherein a pump (not shown) would be utilized in the system, or radiator 3, to continuously circulate the coolant throughout the closed loop fluid flow circuit to be heated by the heating element 5 or heating elements. In an exemplary embodiment, such a closed loop fluid flow circuit will preferably be in a vacuum environment.

Preferably, the heating element 5 is a DC electrical heating element, though it is conceivable that other types of heating elements could be utilized, such as AC heating elements or the like, as would be apparent to one skilled in the art. These can be easily removable and replaceable if required, without disassembly of any other components of the fluid circuit 7. In an exemplary embodiment, the heating elements are made of stainless steel –316, and nickel, though of course it will be understood that variations to this are possible.

The heating element 5 or heating elements are supplied with power from a power source (not shown) for enabling the heating element 5 to heat the coolant within the fluid circuit. In one embodiment, the power source is an electrical type power source, or a power pack, though it is conceivable that, alternatively, other types of power sources could be utilized, such as solar power cells, turbine power, A/C power, DC power, battery power, wind generated power or the like, as would be apparent to one skilled in the art. Of course, it would be readily apparent that a power cell could also be re-energized or re-charged, as is also known in the art. The present invention can be run on from between 50 to 300 watts of power, though it will be understood that variations to this are possible. In an exemplary embodiment, the system can run on only 100 watts of power.

In a further embodiment, and with reference to FIG. 4, the radiator has a thermostatic control 9 in association with the heating elements 5 and the other components therein, connected in a conventional manner, and which would be adapted to turn the heating element 5 off when a temperature of the coolant within the fluid circuit or closed loop fluid flow circuit meets a pre-determined level, or when it is detected that a component has failed. For example, if a pump malfunctions and is no longer circulating the coolant, or if there is insufficient coolant in the system, the thermostatic control 9 effects the shut down of the heating element 5 or heating elements. Additionally, the thermostatic control can be adapted to turn the heating element 5 on when a temperature of the coolant within the radiator 3 falls below a pre-determined level. In an alternative embodiment, a timer (not shown) can also be utilized to selectively pre-set a temperature at which to activate and/or de-activate the heating element 5 within the radiator 3. Of course, information regarding the thermostatic control 9 is forwarded and controlled, if desired, through a remote device. In an exemplary embodiment, the remote device can be a cell phone, tablet or computing device, though it will be understood that variations to these are possible and numerous, and connections to each of which we well known in the art, such as by cell phone application.

In a further embodiment, and with reference to FIG. 4, the radiator 3 also possesses a sensor 11 for monitoring parameters of the radiator 3 through the remote device. The parameters of the radiator which can be monitored remotely can comprise time of use, temperature and cost of use, though many other variations to this are possible, as would be apparent to one skilled in the art. In this manner, the remote device of the present invention can, as discussed, selectively activate (or deactivate) the radiator 3 from a distance. Of course, the radiator can also contain thereon a conventional on/off switch (not shown), as would be apparent to one skilled in the art.

With reference to FIG. 3, it can be seen that the heating element 5, has begun to heat the fluid (coolant) in the fluid circuit, with the upper portion 13 of the circuit being heated first, while coolant in the lower portion 15 of the circuit remaining cool. As the heating element 5 continues to heat the circuit, the lower portion 15 begins to heat up as well, until the entire circuit is fully heated to throw off heat. Of course, it will be understood that a radiator/covering panel (not shown) can also have thereon visible displays of information that is typically forwarded to the remote device, such as the information concerning the thermostatic control 9 and the parameters from the sensor 11. It will also be understood that the upper portion 13 and lower portion 15 of the circuit 7, as shown in FIGS. 3 and 4, will be interconnected at both ends thereof within the radiator 3.

In an exemplary embodiment, the fluid circuit in the radiator 3 is heated by the heating element 5 to 180 degrees Fahrenheit, at which point the radiator 3, and more importantly, the heating element 5 used to heat the fluid circuit or closed loop fluid flow circuit in the radiator 3, is deactivated for a period of time, and no power is supplied to the radiator 3 or heating element 5. In an exemplary embodiment, this active "turn on" temperature is 80-90 degrees Fahrenheit. It will also be understood, however, that variations as to the deactivation temperature, and the activation temperature within the radiator 3, can be utilized, as would be apparent to one skilled in the art.

In this manner, by virtue of the self-contained nature of the radiator 3, the cost of heating a home utilizing the radiator 3 of the present invention can be reduced, in some cases, drastically with no CO2 or other emissions, resulting in a completely green tech radiator and heating unit.

The present invention has been described herein with regard to preferred embodiments. However, it will be obvious to persons skilled in the art that a number of variations and modifications can be made without departing from the scope of the invention as described herein.

What is claimed is:

1. A variably heatable radiator for heating a space, comprising: a panel with an integrated closed tube forming a closed fluid circuit within the radiator containing only a liquid coolant therein, the tube including at least one opening which is in communication with the fluid circuit; and at least one heating element constructed and arranged for insertion into the at least one opening and projecting into the fluid circuit, the at least one heating element being removable without disassembly of the fluid circuit, whereby the at least one heating element is in direct contact with the liquid coolant to heat the coolant, wherein, when the at least one heating element is inserted into the at least one opening, the closed fluid circuit is in a vacuum environment.

2. The variably heatable radiator of claim 1, wherein the closed tube has a diameter and includes a first segment and a second segment and the at least one heating element is positioned between the first segment and the second segment and extends beyond the diameter of the closed tube.

* * * * *